US008439611B2

(12) United States Patent
Quick et al.

(10) Patent No.: US 8,439,611 B2
(45) Date of Patent: May 14, 2013

(54) TRANSPORT UNIT

(75) Inventors: Dieter Quick, Lindlar (DE); Markus Sünger, Lindlar (DE); Hans Günther Kohl, Köln (DE)

(73) Assignee: Sonoco Development, Inc., Hartsville, SC (US)

( * ) Notice: Subject to any disclaimer, the term of this patent is extended or adjusted under 35 U.S.C. 154(b) by 226 days.

(21) Appl. No.: 12/655,951

(22) Filed: Jan. 11, 2010

(65) Prior Publication Data

US 2010/0178127 A1 Jul. 15, 2010

(30) Foreign Application Priority Data

Jan. 9, 2009 (DE) ..... 20 2009 000 365 U

(51) Int. Cl.
*B60P 7/08* (2006.01)

(52) U.S. Cl.
USPC ..... 410/42; 410/41; 410/48; 410/100; 410/155

(58) Field of Classification Search ..... 410/36, 410/41, 32, 42, 46, 47, 48, 99, 100, 155; 211/59.4, 70.4, 85.5; 206/443, 446, 394, 206/586, 397, 415, 416, 414, 413, 405, 406; 248/499
See application file for complete search history.

(56) References Cited

U.S. PATENT DOCUMENTS

| | | | | |
|---|---|---|---|---|
| 2,335,518 | A * | 11/1943 | Koonce | 410/42 |
| 3,229,825 | A | 1/1966 | Brown, Jr. | |
| 3,237,786 | A | 3/1966 | Milliken | |
| 5,538,376 | A * | 7/1996 | Borda | 410/99 |
| 5,692,625 | A | 12/1997 | Filipescu et al. | |
| 5,735,412 | A * | 4/1998 | Sheckells | |
| 5,954,465 | A * | 9/1999 | Ellerbush | 410/49 |
| 7,641,059 | B2 | 1/2010 | Gracia Lecina | |
| 2004/0020168 | A1 | 2/2004 | Simonsen et al. | |
| 2010/0178127 | A1 | 7/2010 | Quick et al. | |

FOREIGN PATENT DOCUMENTS

| | | |
|---|---|---|
| DE | 202009000365 U9 | 8/2009 |
| FR | 2876678 | 4/2006 |
| GB | 2252293 | 8/1992 |
| WO | WO 01/58718 | 8/2001 |
| WO | WO 2007/111506 A1 | 10/2007 |

OTHER PUBLICATIONS

European Search Report for EP Application 09 178300.1 (Dated Mar. 17, 2010).
Extended European Search Report for EP Application 09 178300.1 (Dated Jun. 21, 2010).

* cited by examiner

*Primary Examiner* — Stephen Gordon
(74) *Attorney, Agent, or Firm* — Flaster/Greenberg PC

(57) ABSTRACT

A transport unit including a plate shaped transport base with cylindrical cargo objects placed there on disposed with their center axes parallel to one another and in at least one layer, wherein the center axes respectively have a distance from one another and wherein enveloping surfaces of adjacent objects are in a line contact with one another, and cargo securing devices configured as tension devices, through which the objects are secured on the base against sliding or rolling. A base which is characterized by an improved utilization of the transport volume and for which the fixation of the objects can be provided in a simply and comfortably, it is provided that tension devices engage a face of the objects and at least each object disposed at an edge of a layer is connected at the face with a tension device in a force transmitting manner.

24 Claims, 4 Drawing Sheets

TRANSPORT UNIT

RELATED APPLICATIONS

This application claims priority from and incorporates by reference German utility model application DE 20 2009 000 365.5, filed on Jan. 9, 2009.

FIELD OF THE INVENTION

The present invention relates generally to a transport unit and adapter therefore, and more particularly, to a transport unit with a plate shaped transport base and tension devices and adapter therefore.

BACKGROUND

The present invention relates to a transport unit including:

a plate shaped transport base;

cylindrical cargo objects placed there on, which are disposed with their center axes parallel to one another and in at least one layer, wherein the center axes respectively have a distance from one another and wherein enveloping surfaces of adjacent cargo objects are in a line-contact with one another; and cargo securing devices configures as tension devices, through which the cargo objects are secured on the transport base against sliding or rolling from their locations.

The invention furthermore relates to an adapter for inserting into or sliding onto a sleeve shaped end section of a winding core of a cargo object provided as a coil made of web shaped material. Pallets of any type are suitable in particular as transport bases since they can be moved by forklifts in a simple manner, even when the pallets are already provided with cargo objects.

Usually, the cylindrical cargo objects typically have a significantly smaller diameter than length and thus are not suitable for a "standing" transport are stacked lying horizontally mostly in several layers on top of one another, wherein the number of the cargo objects disposed in one layer adjacent to one another decreases from the lowest layer to the top layer. This is required since the cylindrical cargo objects of an upper layer are disposed in the indentations of a layer disposed there under, so that they are respectively supported on two cargo objects of the layer disposed thereunder.

When the lowest layer includes, for example, three cargo objects disposed to adjacent to one another, the second layer disposed there above includes only two cargo objects and the uppermost third layer only includes one cargo object. Thus stacks with a triangular or also trapeze shaped cross section are created, the latter is created when the upper layer includes more than one cargo object.

Typically, tension devices in the form of strong tension cables or bands made of metal or textile reinforced plastic are used as cargo securing devices, which are pulled tight about the triangular cross section of the stacked cargo objects including the transport base and which are supported at the enveloping surfaces of the outer cargo objects. Before the cargo objects are wrapped tight, the lowest layer should initially be fixated with a type of wedge, wherein wedges made of wood or plastic material can be used. Also cardboard strips can be used as wedges, which cardboard strips are provided, for example, with an indentation corresponding to the cargo objects.

The unfavorable ratio of transport volume required to actual transport volume provided, thus the ratio gross/net is a disadvantage of the known transport units, which becomes more unfavorable as more layers are stacked on top on one another. Namely in the known type of stacking certain free spaces are left unused at the edges of the layers, other than the lowest layer.

From U.S. Pat. No. 5,931,435 A1 a pallet for storing and transporting cylindrical objects is known which are positioned adjacent to one another on the pallet so that their longitudinal axes are aligned. In order to assure that these objects cannot simply roll off from the pallet, the pallet has a depression in its center that extends in a longitudinal direction of the pallet. Furthermore, the objects are fixated by tension devices that are tightened against the pallet starting at the core of the cylindrical objects. However, storing cylindrical objects disposed vertically above one another is not possible for the known pallet.

SUMMARY OF THE INVENTION

Thus, it is an object of the present invention to improve a transport unit of the known type, so that it is characterized by a better use of the transport volume and the fixation of the cargo objects can be provided in the simplest and most comfortable manner possible.

This object is accomplished according to the invention in that tension devices engage a face of the cargo objects and at least each cargo object disposed at an edge of a layer is connected at a face to a tension device in a load bearing manner.

The connection of the cargo objects with a tension device which engages their faces is advantageous for handling since the tension device can be applied very comfortably and without any risk from cargo objects rolling away in lateral direction unintentionally.

When the cargo devices are disposed in at least two layers on top of one another, wherein enveloping surfaces of adjacent cargo objects in vertically adjacent layers are in a line contact with one another, the cargo objects of an upper layer are disposed in the indentations of a lower layer, which generates forces that press the cargo objects of the respective lower layer away from one another. Thus the forces are oriented in a horizontally outward direction. Conventionally, these forces are compensated in that the packet formed by the stacked cargo objects is provided at its circumference with a circumferential tension device that retains the cargo objects in their respective positions. Thus, the only option to obtain sufficiently large forces counteracting the horizontally outward oriented forces, is a suitable path of the tension device which creates the typical triangular or trapeze shaped cross section of the transport unit. Namely, when the cargo objects are stacked on top of one another, so that an approximately rectangular shape is created in cross section, wherein particular cargo objects can protrude beyond a cargo object disposed there under, the tension devices extending in vertical direction at the circumference will not be able to support any significant horizontal forces and a fixation of the transport unit is almost impossible when the particular cargo objects have a high weight.

Differently from the known transport units, in which the tension devices only engage partial portions of the circumferences of the cargo objects, the tension devices according to the invention respectively engage faces of cargo objects. This way is possible in a simple manner to provide a transport unit with tension devices that transfer the forces created into the interior of the transport unit, which provides a better counteraction against the forces that press the cylindrical cargo objects apart from one another.

Thus, the orientation of the tension devices does not depend on the geometry of the transport unit viewed in cross section and the tension device can be applied much more effectively.

Advantageously, the tension devices respectively engage a center portion of the faces of the cargo objects, which often corresponds to a center of gravity of the cross section of the cargo objects. Thus, the engagement point of the tension device is selected, so that a rotation of the particular cargo objects, differently from mounting the tension device, for example, at an outer point of the face, cannot occur due to the tension force of the tension device.

An advantageous embodiment of the invention provides that the center portions of the cargo objects connected to the tension device are connected to a separate tension device in one respective layer. This means that at least the two outer cargo objects of a layer are connected to cargo objects with the same dimensions through a horizontally extending tension device. However it is not required for the present invention that the particular cargo devices include identical dimensions, the tension device according to the invention is rather flexible for any combination of cargo devices. Thus, a tension device connecting the cargo objects of a layer can also be inclined relative to horizontal. In any case attaching the respective separate tension devices of a layer of the transport unit is advantageous with respect to handling, since the particular tension devices can be attached quite comfortably and in turn without any endangerment from cargo objects unintentionally rolling off in lateral direction.

When at least each cargo device disposed at an edge of a layer is connected respectively at both of its opposite faces, in particular in the central portions in a force transferring manner with a tension device, a transport unit is created which is held together in a very stable manner. Looking at the cargo objects in longitudinal direction, they are fixated namely at their first face as well as at their second face.

Another embodiment of the transport unit according to the invention provides that the cargo objects are coils of a web shaped product, for example foil or paper and that the coils respectively include a particularly sleeve shaped winding core, wherein the end sections of each winding core form the center portions or the center portions are formed by adapters which are inserted into sleeve shaped end sections of the winding cores or which are slid onto the end sections of the winding cores and which are connected to the winding cores respectively in a friction locked and/or form locked manner. This way the components disposed at the cargo objects anyhow are used for applying the tension devices. Typically, the winding cores are made from cardboard or plastic material. Alternately, adapters can also be used which are configured in particular for applying the tension devices.

The transport unit according to the invention facilitates a configuration of the tension devices as ropes, wires, bands, beams or rods, wherein they can be configured flexible or rigid viewed circumferentially. The strength in longitudinal direction has to facilitate at least the safe transmission of the occurring tension forces.

In order to make the connection of the tension devices with the respective cargo objects as easy to handle as possible and in order to facilitate a reuse of the tension devices, it is provided according to a configuration of the invention to configure the tension devices viewed in longitudinal direction at a plurality of locations, so they can be connected with the cargo objects, in particular with their winding cores or the adapters connected there with, in a disengageable manner through a closure.

It is advantageous in particular when the tension device can be connected to the respective cargo object through inserting the tension device into the closure in a direction perpendicular to the center axis.

It is furthermore advantageous when the tension device is provided at least on one side at least in sections with a teething, which can be brought into formed locked engagement with a moveable interlocking link of the closure device. This means that the respective alignment of the teething is provided, so that moving the tension device in the closure is possible in one direction, but not in the opposite direction.

It is advantageous when the adapter, the closure and the interlocking link which is configured as an interlocking tongue, are configured as plastic injection molded components.

According to an embodiment of the invention, the adapters include a sleeve shaped insertion section, which is provided at its outer enveloping surface with radially outward protruding bars which extend in the direction of the center axis of the insertion section and which is provided at its inner enveloping surface with radially inward protruding ribs extending in the direction of the center axis of the insertion section and with a flange section protruding radially beyond the outer enveloping surface of the insertion section and connected there to at its face, which flange section comprises a closure in the form of a guide channel for inserting the tension device, wherein a wall section of the guide channel is configured as a spring loaded tongue. Such an adapter facilitates a quick and simple connection with the respective tension device.

When the outer diameter of the flange section corresponds at the most to the outer diameter of the winding core it is assured that the adapter does not protrude into the portion of the coil, so that no damages can occur at the web material forming the coil, when the adapter is applied.

The invention furthermore relates to an adapter for inserting into or sliding onto a sleeve end section of a winding core, which creates a friction locked and/or form locked connection between adapter and winding core. According to the invention the winding core is provided with a device for mounting a tension device and can be used in particular for forming a transport unit as described supra.

Advantageously, the adapter as described supra is comprised of a sleeve shaped insertion section with radially outward protruding bars, radially inward protruding reinforcement ribs and a flange section which comprises a closure in the form of a guide channel for inserting the tension device, wherein a wall section of the guide channel is configured as a spring elastic tongue.

BRIEF DESCRIPTION OF THE DRAWINGS

The invention will be described subsequently in more detail with reference to a transport unit according to the invention or an adapter according to the invention which are described in more detail in the figures, wherein.

DETAILED DESCRIPTION

Figure 1:
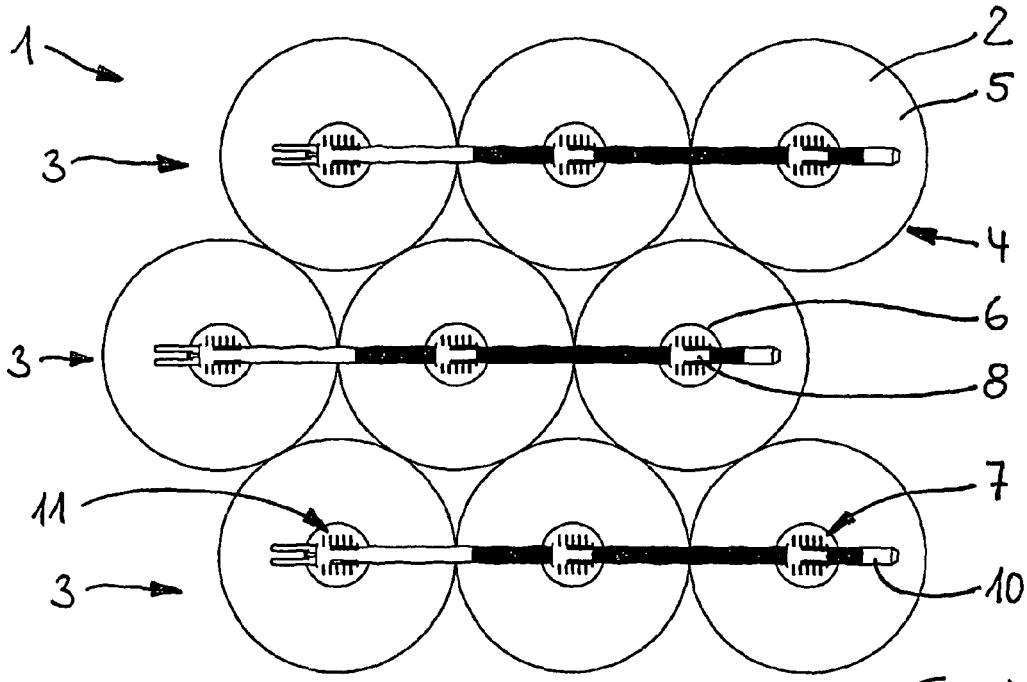
FIG. 1 illustrates a side view of a transport unit according to the invention.
Figure 2:
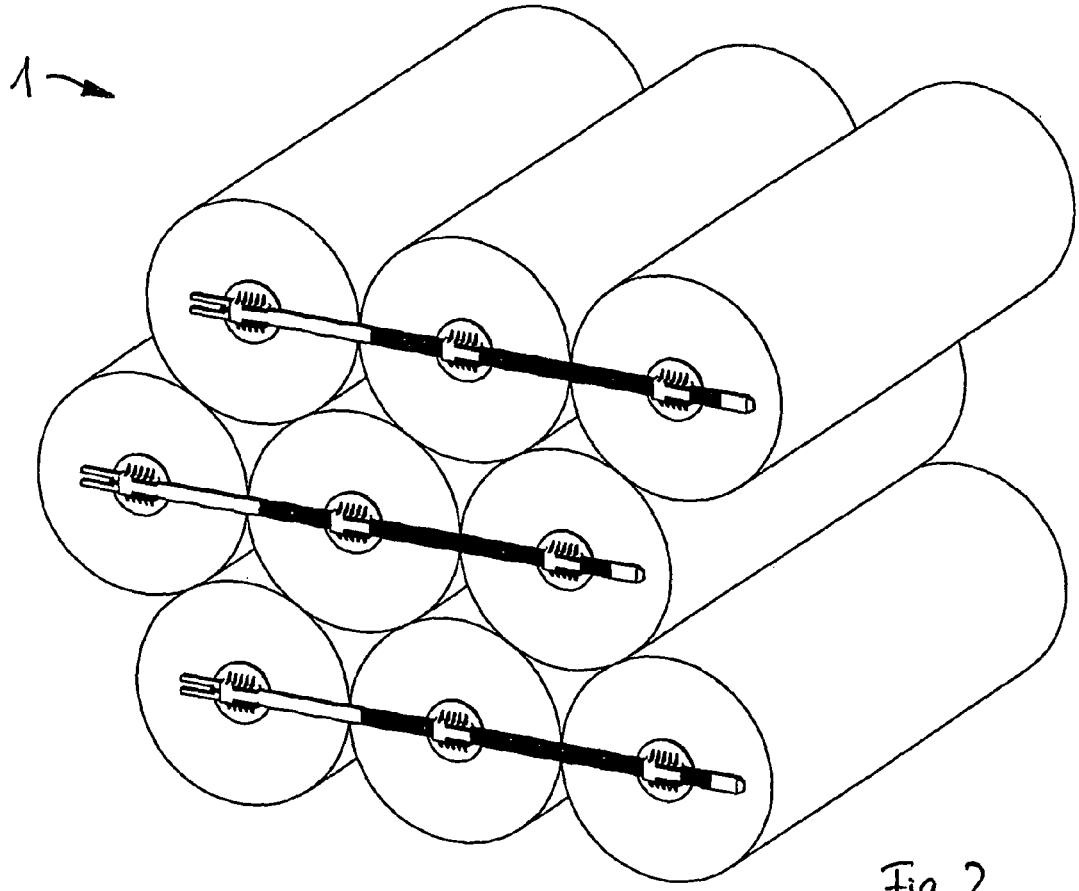
FIG. 2 illustrates a three dimensional view of a transport unit according to FIG. 1.

FIG. 1 and FIG. 2 illustrate a transport unit 1 according to the invention, to once in a side view of one of the faces 2 of the transport unit and once as a three dimensional view, wherein an illustration of a pallet shaped base was omitted. The transport unit 1 according to the invention is formed from three layers 3 of three respective cargo objects 4 disposed parallel to one another. The cargo objects 4 are coils 5 of a web shaped foil, which coils are wound onto a sleeve shaped winding core 6 made of cardboard. The diameter of a coil 5 is typically between 30 cm and 60 cm and the length is approximately 4.00 m. Compared to the conventional transport units that can include at the most a total of six cargo objects with a lowest layer of three cargo objects, a transport unit 1 according to the invention is formed with 9 cargo objects 4. In this case, the transport unit 1 according to the invention holds 50% more material than a known transport unit with the transport volume almost unchanged.

Figure 10:
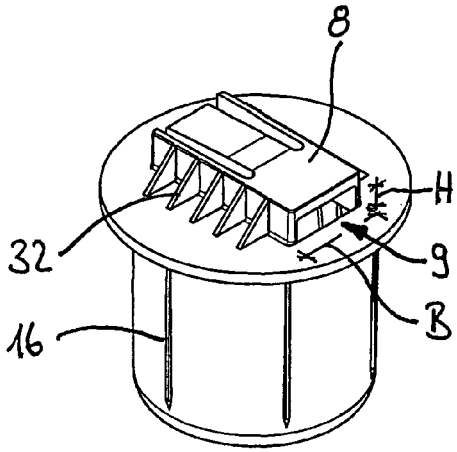

Adapters 7 are inserted respectively into the openings of the winding cores 6, which are connected to the winding cores 6 through friction locking and form locking. On their side facing away from the opening, the adapters 7 respectively include a closure 8 which comprises a guide channel 9 (re. FIG. 10) for inserting a tension device 10. Thus, the adapters 7 form central portions 11 at the faces 2 of the cargo objects 4 in which the cargo objects 4 are connected to the tension device 10 in a force transferring manner.

Thus, the cargo objects 4 of a layer 3 are connected respectively with a separate horizontally extending tension device 10, so that the cargo objects 4 of a layer 3 are connected to form a layer. Thus a "rolling apart" of the cargo objects 4 is not possible anymore, wherein it also suffices according to the invention when only the outer cargo objects 4 are connected with the tension device 10.

Figure 3:
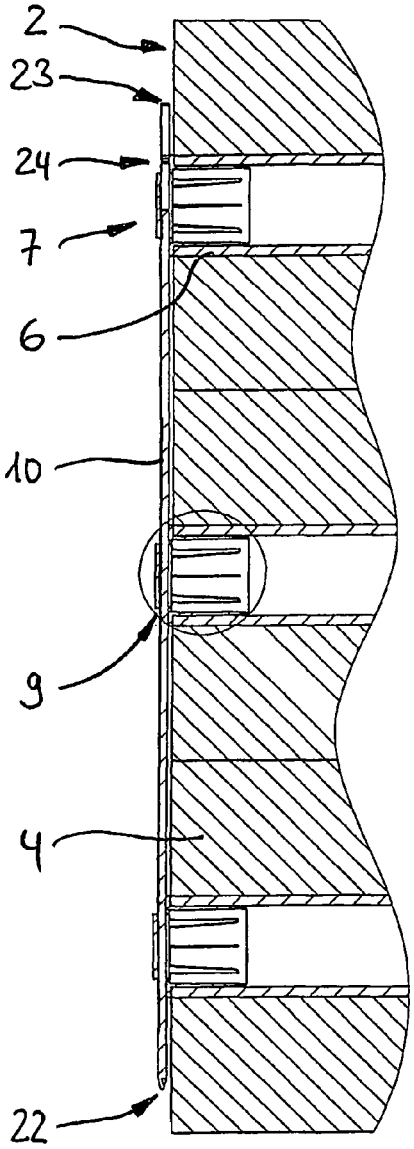
FIG. 3 illustrates a horizontal sectional view through a transport unit according to FIG. 1 in a face portion.
Figure 4:
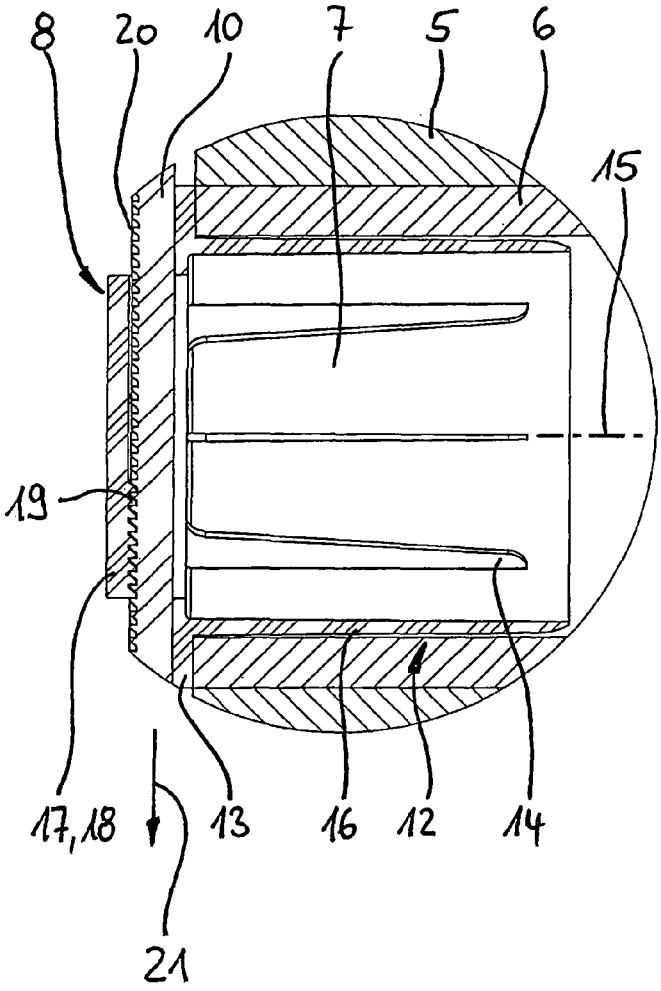
FIG. 4 illustrates an enlarged detail of FIG. 3 in the portion of an adapter.

The formed lock connection between the adapters 7 and the tension devices 10 becomes more clearly apparent from the FIGS. 3 and 4 which show a sectional view of the transport unit 1 in the portion of a face 2 of the transport unit or an enlarged illustration of an adapter 7 in the winding core 6 in a sectional view as well.

The adapter 7 which is integrally fabricated as an injection molded plastic part includes a sleeve shaped insertion section 12, a flange section 13 radially protruding beyond the enveloping surface of the insertion section 12 and connected at the face side to the insertion section 12, and the closure 8 cited supra. For stabilization purposes, the sleeve shaped insertion section 12 includes six inner reinforcement ribs 14, three of which are visible in the figure. They extend along the inner enveloping surface of the insertion section 12, wherein they protrude in radially inward direction and extend in parallel to the center axis 15 of the insertion section 12.

The insertion section 12 includes bars 16 at its outer enveloping surface, which bars also extend in parallel to the center axis 15 of the insertion section 12 and protrude radially in outward direction. Thus, the height of the radially outward protruding bars 12 slightly decreases starting at the flange section 13 towards the opposite end of the insertion section 12. This provides a friction locked and formed lock connection between the adapter 7 and the winding core 6 in a particularly simple manner, wherein in particular the further protruding portions of the bars 16 are impressed into the cardboard of the winding core 6.

The closure 8 of the adapter 7 is formed by the recited guide channel 9, wherein a wall section 17 of the guide channel 9 which wall section faces away from the insertion portion 12 is configured as a spring elastic tongue 18, which is provided with a teething 19 over a portion of its length.

The tension device which is connected with the cargo objects 4 in a force transmitting manner comprises a teething 20 on one of its longitudinal sides, which corresponds to the teething 19 of the tongue 18, so that an insertion of the tension device 10 in the direction illustrated by the arrow 21 is possible based on the orientation of the teeth 19, 20 and based on the fact that the tongue is configured as a spring elastic tongue 18, however the insertion is not possible in opposite direction. Such closures are known, for example, from so called cable ties.

Figure 5:
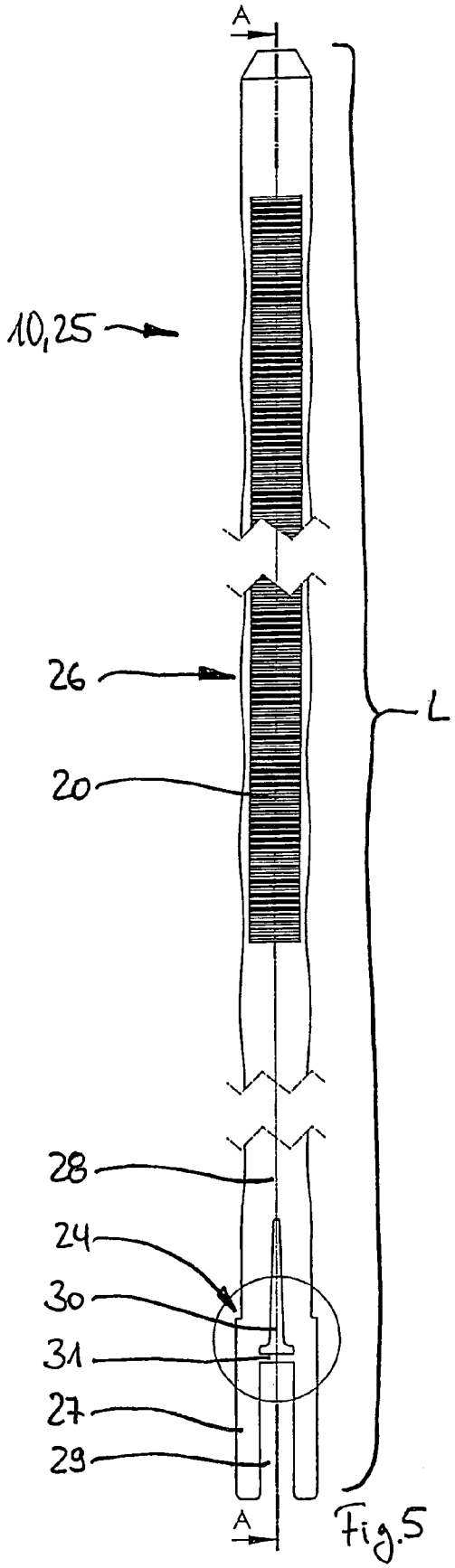
FIGS. 5-8 illustrate various views and details of the tension device.
Figure 6:
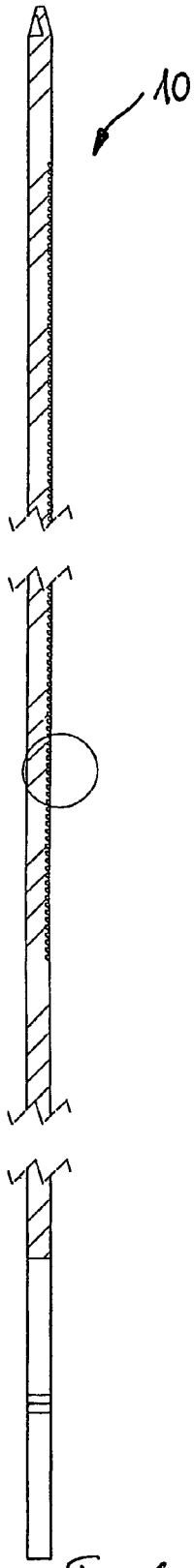

As evident from FIG. 3, the tension device 10 is pushed from one side through the three guide channels 9 of the adapter 7 of the adjacent cargo objects 4, wherein a movement of the tension device 10 is only possible in the direction of the arrow 21. At the end 22, where the tension device 10 is inserted into the guide channels 9, the tension device is configured conical, so that its insertion into a guide channel 9 is simplified. The opposite end 23 of the tension device 10 has a stop 24, (re. FIG. 5) which is formed by a cross section increase of the tension device 10. The stop 24 assures that the tension device 10 does not slide completely through the guide channels 9 and thus would be ineffective.

The exact configuration of the tension device 10 which is rectangular in cross section can be derived from the FIGS. 5 through 8. The tension device 10 provided in the form of a rigid bar 25 has a rectangular cross section with 2 short sides and 2 long sides wherein the long side approximately corresponds to the width B of the guide channel 9, or slightly undercuts said width and the short side approximately corresponds to the height of the guide channel 9 or slightly undercuts this height. However, the cross section of the tension device 10 does not extend continuously over its length L, rather the width of the long sides of the rectangular cross section changes, so that two wave shaped side surfaces 26 are created. Through an intentional extension of the surface, this way a reduction of the stresses in the material, in particular of the critical tension can be provided, which occur for a bending load on the tension device 10 which cannot be excluded during operation and which otherwise create the risk of forming a fracture.

Figure 8:
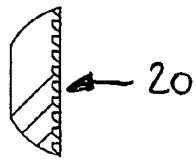
Figure 7:
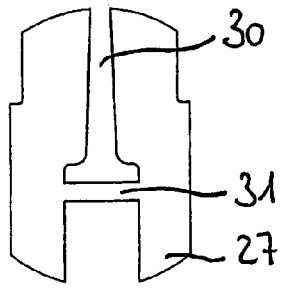

The bar 25 is provided with a teething 20 as recited supra on a large portion of one of its wide side surfaces, which teething is shown in detail in FIG. 8.

In FIG. 5, the fork shaped end 23 of the tension device 10 is visible quite well which end forms the stop 24. The actual stop 24 is formed by a cross section increase which however only relates to the wide sides of the cross section of the bar 25. Below the stop 24, the bar 25 is comprised of two parallel legs 27, which extend in parallel to the center axis 28 of the bar 25 and which are separated from one another through an incision 29. This creates the shape of a two pronged fork.

Above the legs 27 described supra, the bar 25 is provided with a recess 30 which comprises the shape of an inverted T. Starting at the cross bar of the T, the width of the recess 30 decreases, so that the vertical bar of the T assumes the shape of an elongated triangle. The recess 30 and the incision 29 between the legs 27 are separated from one another through a connection bar 31.

The configuration of the end 23 of the bar 25 with the recess 30 and the incision 29 facilitates to manually compress the end 23 of the bar 25 after cutting or removing the connection bar 31, so that the widened cross section serving as a stop 24 is reduced, so that the bar 25 can be pulled out of the closures 8 of the adapter 7. This way, the connection of the tension device 10 with the adapters 7 can be disengaged in a simple manner without the spring loaded tongues 18 having to be manipulated. Alternatively, the end 23 of the bar 25 can also be configured, for example, through a connection bar which is flexible within limits, so that the connection between the tension device 10 and the adapters 7 can be removed without damaging any of the components.

Figure 9:
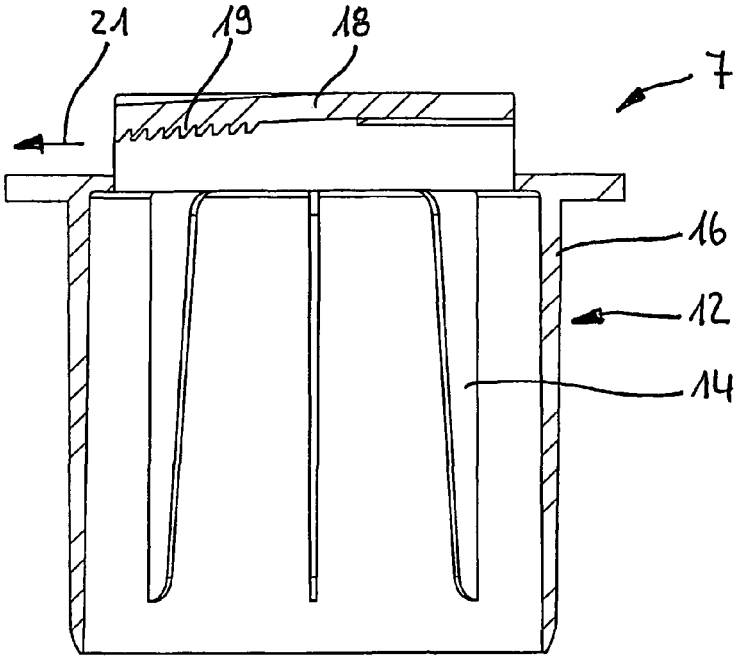
FIGS. 9-11 illustrate various views of the adapter.
Figure 11:
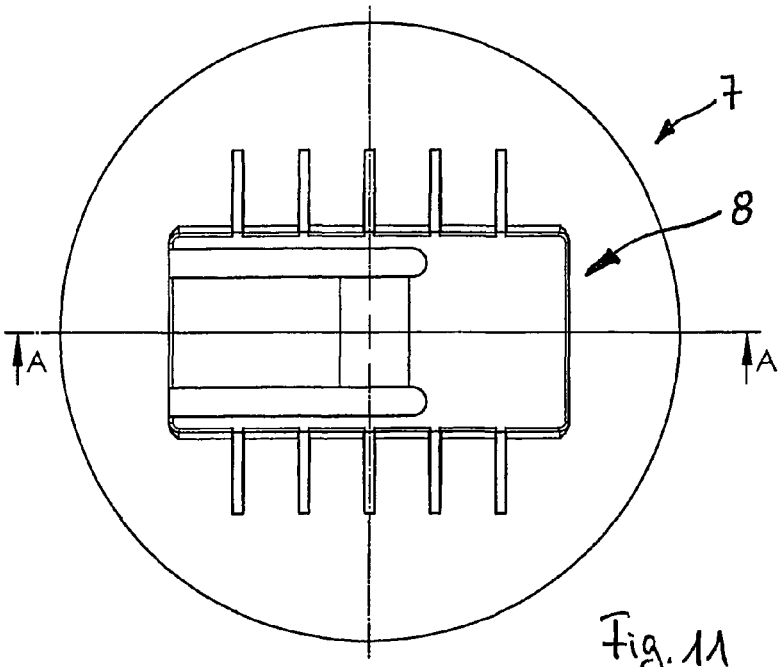

In FIGS. 9 through 11 the adapter 7 is shown in various respective perspectives. FIG. 9 shows a vertical sectional view of the adapter 7 in which three of the reinforcement bars 14 disposed in the cavity of the sleeve shaped insertion section 12 are visible. The bars 16 at the outer enveloping surface are visible in FIG. 9 only in so far as the thickness of the insertion section 12 slightly increases from its free end to the flange section 13.

Furthermore, the alignment of the teeth 19 at the spring elastic tongue 18 is clearly visible from FIG. 9, which tongue facilitates a movement of the tension device 10, which is also configured with teeth 20, into the direction indicated by the arrow 21, but not into the opposite direction.

FIG. 10 shows the adapter 7 in three dimensions, wherein the guide channel 9 and the reinforcement ribs 14 extending within the insertion section 12 are visible. The closure 8 is configured respectively with ribs 32 at its long sides in order to increase its stability. Furthermore, the bars 16 at the outer enveloping surface of the insertion section 12 are illustrated.

FIG. 11 illustrates a top view of the closure 8 of the adapter 7.

Although several embodiments of the present invention and its advantages have been described in detail, it should be understood that changes, substitutions, transformations, modifications, variations, permutations and alterations may be made therein without departing from the teachings of the present invention, the spirit and the scope of the invention being set forth by the appended claims.

REFERENCE NUMERALS AND DESIGNATIONS

1 Transport unit
2 Face
3 Layer
4 Cargo Object
5 Coil
6 Winding core
7 Adapter
8 Closure
9 Support Channel
10 Tension Device
11 Central portion
12 Insertion section
13 Flange section
14 Reinforcement Rib
15 Center Axis
16 Bar
17 Wall Section
18 Spring Elastic Tongue
19 Teething
20 Teething
21 Arrow
22 End
23 End
24 Stop
25 Bar
26 Wave shaped side surface
27 Leg
28 Center Axis
29 Incision
30 Recess
31 Connection Bar
32 Rib
B Width
H Height
L Length

What is claimed is:

1. A transport unit comprising:

a plate shaped transport base;

a plurality of cylindrical cargo objects placed on the base, the cylindrical cargo objects each having a center axis, an outer periphery and two opposing end faces, the cargo objects disposed adjacent one another with their center axes positioned parallel to one another and formed in at least one layer, wherein the outer periphery of each of the cargo objects defines and enveloping surface for the cargo object, with the enveloping surfaces of adjacent ones of the cargo objects positioned in a line contact with one another and the center axis of each cargo object spaced from one another;

cargo securing devices for engaging at least one of the opposing end faces on at least two of the cargo objects, the at least two cargo objects disposed at an edge of the at least one layer, and a tension device connecting the cargo securing devices engaging the at least two cargo objects in a force transmitting manner, wherein the at least two cargo objects are secured on the base against sliding or rolling from their locations in the at least one layer, the cargo securing devices comprising an insertion section for inserting into and frictionally engaging an end section adjacent the respective end face of the cargo object, a flange section connected to the insertion section, the flange section positioned adjacent the end face of the cargo object when the insertion section is engaged within the end section of the cargo object, and a closure for receiving and resiliently securing the tension device to the cargo securing device, the closure formed on the flange section, the closure having a guide channel and including a spring tongue for frictionally engaging the tension device.

2. A transport unit according to claim 1, wherein the cylindrical cargo objects are disposed in at least two layers above one another, wherein the enveloping surfaces of adjacent ones of the cylindrical cargo objects within one of the at least two layers are in a line contact with adjacent ones of the cylindrical cargo objects within the other of the at least two layers.

3. A transport unit according to claim 1, wherein the tension device engages the cargo securing devices at a central portion of the opposing end faces of the two cargo objects.

4. A transport unit according to claim 2 , wherein separate tension devices are provided on at least two layers of cargo objects, and wherein each of the separate tension devices respectively engage cargo securing devices at a central portion of the end faces of at least two cargo objects disposed at an edge of the each of the respective layers.

5. A transport unit according to claim 1, wherein the cylindrical cargo objects disposed at an edge of the at least one layer are connected with the tension device in a force transmitting manner on both of their respective opposing end faces.

6. A transport unit according to claim 3, wherein the cylindrical cargo objects are coils of a web shaped product, rolled around a hollow winding core, wherein end sections of each winding core are formed at a central portion of the end faces of the cargo objects, and wherein the cargo securing devices comprise adapters inserted into the end sections of the winding core and respectively connected to the tension device.

7. A transport unit according to claim 1, wherein the tension device is selected from the group comprising ropes, wires, bands, bars and rods and wherein the tension device is flexible in a longitudinal direction.

8. A transport unit according to claim 1, wherein the tension device can be connected within the guide channel in a disengageable manner at a plurality of locations.

9. A transport unit according to claim 8 , wherein the tension device is connected to the closure by inserting the tension device into the guide channel in a direction perpendicular to the center axis of the cylindrical cargo object to which the cargo securing device is engaged.

10. A transport unit according to claim 9, wherein the tension device is provided on at least one side with a teething, which can be brought into locking engagement with the spring tongue formed on the closure.

11. A transport unit comprising:

a plate shaped transport base;

a plurality of cylindrical cargo objects placed on the base, the cylindrical cargo objects each having a center axis, an outer periphery and two opposing end faces, the cargo objects disposed adjacent one another with their center axes positioned parallel to one another and formed in at least one layer, wherein the outer periphery of each of the cargo objects defines and enveloping surface for the cargo object, with the enveloping surfaces of adjacent ones of the cargo objects positioned in a line contact with one another and the center axis of each cargo object spaced from one another; and cargo securing devices for engaging at least one of the opposing end faces on at least two of the cargo objects, the at least two cargo objects disposed at an edge of the at least one layer, a tension device connecting the cargo securing devices associated with the at least two cargo objects in a force transmitting manner, wherein the at least two cargo objects are secured on the base against sliding or rolling from their locations in the at least one layer, wherein the cargo securing devices each comprise a closure and wherein the respective tension device can be connected in a disengageable manner at a plurality of locations to the closure, wherein the tension device is connected to a cargo securing device within a cylindrical cargo object by inserting the tension device into the closure in a direction perpendicular to the center axis of the cylindrical cargo object, wherein the tension device is provided on at least one side with a teething, which can be brought into locking engagement with a moveable locking link formed on the closure, and wherein the locking link comprises a spring elastic tongue and wherein the closure is formed by plastic injection molded components.

12. A transport unit comprising:

a plate shaped transport base;

a plurality of cylindrical cargo objects placed on the base, the cylindrical cargo objects each having a center axis, an outer periphery and two opposing end faces, the cargo objects disposed adjacent one another with their center axes positioned parallel to one another and formed in at least one layer, wherein the outer periphery of each of the cargo objects defines and enveloping surface for the cargo object, with the enveloping surfaces of adjacent ones of the cargo objects positioned in a line contact with one another and the center axis of each cargo object spaced from one another; and cargo securing devices for engaging at least one of the opposing end faces on at least two of the cargo objects, the at least two cargo objects disposed at an edge of the at least one layer, a tension device connecting the cargo securing devices associated with the at least two cargo objects in a force transmitting manner, wherein the at least two cargo objects are secured on the base against sliding or rolling from their locations in the at least one layer, wherein the tension device engages the cargo securing devices at a central portion of the opposing end faces of the two cargo objects, wherein the cylindrical cargo objects are coils of a web shaped product, rolled around a hollow winding core, wherein end sections of each winding core form the central portions of the faces of the cargo objects, and wherein the cargo securing devices comprise adapters inserted into the end sections of the winding core and respectively connected to the tension device in a friction locked manner, and wherein the adapters comprise a sleeve shaped insertion section and a flange section, the insertion section having an outer enveloping surface with radially outward protruding bars thereon and an inner enveloping surface with radially inward protruding reinforcement ribs, and the flange section radially protruding beyond the outer enveloping surface of the insertion section and connected at a face portion of the insertion section, the flange section having a closure in the form of a guide channel for inserting the tension device, wherein a wall section of the guide channel is configured as a spring elastic tongue.

13. A transport unit according to claim 12, wherein an outer diameter of the flange section is less than or equal to an outer diameter of the winding core.

14. An adapter for inserting into an end section of a hollow winding core, the adapter comprising:

a sleeve shaped insertion section for inserting into an end section of the winding core, the insertion section having an outer enveloping surface surrounding a central longitudinal axis, the enveloping surface have radially outward protruding bars thereon, the protruding bars creating a friction lock with the winding core and forming a frictional connection between the insertion section and the winding core;

a flange section connected to the insertion section at a face portion on one axial end of the insertion section, the flange section radially protruding beyond the outer enveloping surface of the insertion section; and a closure device for receiving and resiliently securing a tension device, the closure device formed on the flange section, the closure device having a closure in the form of a guide channel, the guide channel positioned transverse to the axis of the enveloping surface of the insertion section, the guide channel having a spring tongue for frictionally engaging a tension device.

15. An adapter for inserting into an end section of a hollow winding core, the adapter comprising:

a sleeve shaped insertion section for inserting into an end section of a winding core;

a friction lock for forming a frictional connection between the insertion section and the winding core; and a device for receiving and resiliently securing a tension device, wherein the sleeve shaped insertion section is provided at an outer enveloping surface with radially outward protruding bars and is provided at an inner enveloping surface with radially inward protruding reinforcement ribs, and wherein the adapter further comprises a flange section radially protruding beyond the outer enveloping surface of the insertion section and connected at a face portion of the insertion section, the flange section having the device thereon, the device having a closure in the form of a guide channel for insertion of the tension device and wherein a wall section of the guide channel is configured as a spring elastic tongue.

16. A transport unit comprising:

a plate shaped transport base;

a plurality of cylindrical cargo objects placed on the base, the cylindrical cargo objects each having a center axis, an outer periphery and two opposing end faces, the cargo objects disposed adjacent one another with their center axes positioned parallel to one another and formed in at least one layer, wherein the outer periphery of each of the cargo objects defines, and enveloping surface for the cargo object, with an enveloping surfaces of adjacent ones of the cargo objects positioned in a line contact with one another and the center axis of each of the cargo objects spaced from one another; and cargo securing devices for engaging at least one of the opposing end faces on at least two of the cargo objects, the at least two cargo objects disposed at an edge of the at least one layer, a tension device connecting the cargo securing devices associated with the at least two cargo objects in a force transmitting manner, wherein the at least two cargo objects are secured on the base against sliding or rolling from their locations in the at least one layer, wherein the cargo securing devices each comprise an adapter having a friction lock closure thereon, each adapter forming a connection with another one of the adapters by means of the tension device engaged within the friction lock closure , and wherein the adapters further comprise a sleeve shaped insertion section which is provided at an outer enveloping surface with radially outward protruding bars and which is provided at an inner enveloping surface with radially inward protruding reinforcement ribs, and a flange section radially protruding beyond the outer enveloping surface of the insertion section and connected at a face portion of the insertion section, the flange section forming a portion of the closure, the closure having a guide channel for receipt of the tension device, wherein a wall section of the guide channel comprises a spring elastic tongue.

17. A transport unit comprising:

a plate shaped transport base;

a plurality of cylindrical cargo objects supported on the base, the cylindrical cargo objects each having a center axis, an outer periphery and two opposing end faces, the plurality of cargo objects disposed adjacent one another with their center axes positioned parallel to one another and formed in at least one layer in such a manner that the center axes respectively have a distance from one another and the outer peripheries of adjacent ones of the cargo objects are positioned in a line contact with one another, wherein the plurality of cargo objects are each defined by a coil of a web shaped product, with the coil of the web shaped product surrounding a hollow sleeve shaped winding core, and wherein the center axes of the plurality of cargo objects are positioned horizontally on the base; and cargo securing devices each formed by a tension device and a plurality of adapters, the cargo securing devices for securing the plurality of cargo objects on the base and preventing sliding or rolling a respective one of the objects from their supported positions on the base, wherein at least one of the tension devices engaging one of the end face of at least two of the plurality of cargo objects disposed on the base and positioned at an edge of the at least one layer of the plurality of cargo objects, the tension devices securing the at least two cargo objects in a force transmitting manner, and wherein the adapters are inserted into end sections of the respective hollow winding core of the at least two of the cargo objects and respectively connected with the winding core in a friction lock manner, wherein the adapters comprise a sleeve shaped insertion section, the insertion section provided at an outer enveloping surface with radially outward protruding bars and an inner enveloping surface with radially inward protruding reinforcement ribs, and the adapters further comprising a flange section radially protruding beyond the outer enveloping surface of the insertion section and connected at a face portion of the insertion section, the flange section comprising a closure in the form of a guide channel for insertion of one of the tension devices, and wherein a wall section of the guide channel having a spring elastic tongue for engagement of the tension device.

18. A transport unit according to claim 1, wherein the tension device is selected from the group comprising ropes, wires, bands, bars and rods and wherein the tension device is rigid in longitudinal direction.

19. A transport unit according to claim 1, wherein the insertion section of the cargo securing devices comprises an outer enveloping surface surrounding a central longitudinal axis, the enveloping surface having radially outward protruding bars thereon, the protruding bars creating a friction lock within the corresponding cargo object.

20. A transport unit according to claim 19, wherein the flange section is provided on a face portion on one axial end of the insertion section, the flange section radially protruding beyond the outer enveloping surface of the insertion section.

21. A transport unit according to claim 20, wherein the guide channel is positioned transverse to an axis of the enveloping surface of the insertion section.

22. A transport unit according to claim 19, wherein the enveloping surface defines a hollow inner surface, a plurality of radially inward protruding reinforcement ribs are provided on the inner surface.

23. A transport unit according to claim 10, wherein the spring tongue on the closure is provided with a teething formed for engagement with the teething on the tension device.

24. An adapter according to claim 14, wherein the spring tongue is provided on at least one side with a teething, said teething formed for locking engagement with a tensioning device upon insertion into the guide channel.

* * * * *